US009515380B2

(12) United States Patent
Iso et al.

(10) Patent No.: US 9,515,380 B2
(45) Date of Patent: Dec. 6, 2016

(54) PHASE SHIFT/ANTENNA CIRCUIT HAVING A SIGNAL LINE WITH FIRST AND THIRD REGIONS FOR ENGAGING DIELECTRIC MEMBERS AND A SECOND REGION THAT DOES NOT ENGAGE THE DIELECTRIC MEMBERS

(71) Applicant: Hitachi Metals, Ltd., Minato-ku, Tokyo (JP)

(72) Inventors: Naoki Iso, Hitachi (JP); Nobuaki Kitano, Hitachi (JP); Tomoyuki Ogawa, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 32 days.

(21) Appl. No.: 14/600,687

(22) Filed: Jan. 20, 2015

(65) Prior Publication Data

US 2015/0207227 A1 Jul. 23, 2015

(30) Foreign Application Priority Data

Jan. 21, 2014 (JP) ..... 2014-008926

(51) Int. Cl.

| | |
|---|---|
| ***H01P 1/18*** | (2006.01) |
| ***H01Q 3/32*** | (2006.01) |
| ***H01P 9/00*** | (2006.01) |

(52) U.S. Cl.

CPC ..... *H01Q 3/32* (2013.01); *H01P 1/184* (2013.01); *H01P 9/006* (2013.01)

(58) Field of Classification Search

CPC ..... H01P 1/18; H01P 1/184; H01P 9/00; H01P 9/06; H01P 9/006; H01Q 3/32

USPC ..... 333/161

See application file for complete search history.

(56) References Cited

U.S. PATENT DOCUMENTS

| | | | | |
|---|---|---|---|---|
| 5,940,030 | A | 8/1999 | Hampel et al. | |
| 6,816,668 | B2 * | 11/2004 | McDonald | H01Q 3/36 333/161 |
| 7,365,695 | B2 * | 4/2008 | Thomas | H01P 1/184 342/373 |
| 2009/0224848 | A1 * | 9/2009 | Lindmark | H01P 5/16 333/159 |

* cited by examiner

*Primary Examiner* — Benny Lee

(74) *Attorney, Agent, or Firm* — Crowell & Moring LLP

(57) ABSTRACT

An antenna device includes a plurality of phase shift circuits to which distributed signals are respectively input and a plurality of antenna elements to which signals output from the respective phase shift circuits are input. At least one of the plurality of phase shift circuits has a signal line in which a first region in which paired dielectric members are disposed, a second region in which no paired dielectric members is disposed and a third region in which paired dielectric members are disposed are provided in this order along a propagation direction of a signal. Moreover, a characteristic impedance of the first region in a state where the paired dielectric members are not disposed and a characteristic impedance of the third region in a state where the paired dielectric members are not disposed are higher than a characteristic impedance of the second region.

9 Claims, 7 Drawing Sheets

PHASE SHIFT/ANTENNA CIRCUIT HAVING A SIGNAL LINE WITH FIRST AND THIRD REGIONS FOR ENGAGING DIELECTRIC MEMBERS AND A SECOND REGION THAT DOES NOT ENGAGE THE DIELECTRIC MEMBERS

CROSS-REFERENCE TO RELATED APPLICATION

The present application claims priority from Japanese Patent Application No. 2014-008926 filed on Jan. 21, 2014, the content of which is hereby incorporated by reference into this application.

TECHNICAL FIELD OF THE INVENTION

The present invention relates to a phase shift circuit and an antenna device, and more particularly relates to a phase shift circuit and an antenna device effectively applied to a base-station antenna device that exchanges radio waves with a mobile communication terminal such as a mobile phone.

BACKGROUND OF THE INVENTION

A tilt (tilt angle) is often given to a radio wave (beam) emitted from a base-station antenna device serving as one type of antenna device. For example, a downward tilt angle is generally given to a radio wave emitted from a base-station antenna device for a mobile phone. This is because the radio wave emitted from the base-station antenna device needs to be prevented from reaching the outside of an area (cell) assigned to this base-station antenna device. U.S. Pat. No. 5,940,030 (Patent Document 1) discloses one example of a phase shift circuit for giving the tilt angle to a radio wave emitted from an antenna device including a base-station antenna device.

The phase shift circuit disclosed in the Patent Document 1 is provided with a signal line, opposing ground conductors with the signal line interposed therebetween, and a dielectric plate that is inserted in a gap between the signal line and the ground conductor. The dielectric plate is inserted in the above-mentioned gap from a direction perpendicular to an extending direction of the signal line, and is overlapped with the signal line. In the following description, the extending direction of the signal line is referred to as "line length direction", and the direction perpendicular to the extending direction of the signal line is referred to as "line width direction". More specifically, the dielectric plate is inserted in the gap between the signal line and the ground conductor from the line width direction, and is overlapped with the signal line.

The Patent Document 1 describes that, when the amount by which the signal line and the dielectric plate are overlapped with each other, that is, an overlapped area between the signal line and the dielectric plate is varied, the phase of a signal output from the signal line is changed, with the result that the tilt angle of a radio wave emitted from the antenna device is changed.

SUMMARY OF THE INVENTION

The inventors of the present invention have carried out a simulation with respect to the relationship between a frequency change of a signal input to the antenna device and a change in tilt angle of a radio wave emitted from the antenna device. In this simulation, the antenna device is configured of a plurality of phase shift circuits. Moreover, in each of the phase shift circuits, a phase shift circuit provided with a signal line through which a signal is propagated and a first dielectric plate and a second dielectric plate disposed on the signal line along a propagation direction of the signal is used. The first dielectric plate and the second dielectric plate are intersected with the signal line from the line width direction, and when the first dielectric plate and the second dielectric plate are moved, overlapped areas between the signal line and the first dielectric plate (first overlapped area) and between the signal line and the second dielectric plate (second overlapped area) are varied. As a result, the phase to be imparted to a signal in each of the phase shift circuits is changed, so that the tilt angle of a radio wave emitted from the antenna device is changed.

As a result of the above-mentioned simulation, it has been found that the amount of change in the tilt angle relative to the amount of change in the first overlapped area and the second overlapped area is varied by the frequency of an input signal. In other words, it has been found that the amount of change in the tilt angle relative to the amount of movements of the dielectric plates (first dielectric plate and second dielectric plate) is dependent on the frequency of the input signal. More specifically, in an antenna device using a conventional phase shift circuit, if the frequency of signals to be input to the phase shift circuit differs, the tilt angle of radio waves emitted from the antenna device differs even when the amount of movements of the dielectric plates provided in the phase shift circuit is the same.

An object of the present invention is to realize an antenna device in which the amount of change in the tilt angle relative to the amount of movements of the dielectric members provided in the phase shift circuit is not dependent or less dependent on the frequency of an input signal.

The phase shift circuit of the present invention is a phase shift circuit for changing a phase of a signal, and it includes: a signal line in which a first region in which a first dielectric member is disposed, a second region in which no dielectric member is disposed and a third region in which a second dielectric member is disposed are provided in this order along a propagation direction of a signal. Also, a characteristic impedance of the first region where the first dielectric member is not disposed and a characteristic impedance of the third region where the second dielectric member is not disposed are higher than a characteristic impedance of the second region.

In one aspect of the phase shift circuit of the present invention, the first region and the third region have a width smaller than a width of the second region.

In another aspect of the phase shift circuit of the present invention, the first region and the third region have a thickness smaller than a thickness of the second region.

In another aspect of the phase shift circuit of the present invention, the first dielectric member and the second dielectric member are movable in a direction intersecting with the signal line. The first region includes an overlapped region that is overlapped with the first dielectric member and a non-overlapped region that is not overlapped with the first dielectric member. Also, the third region includes an overlapped region that is overlapped with the second dielectric member and a non-overlapped region that is not overlapped with the second dielectric member. Then, an area ratio between the overlapped region and the non-overlapped region in the first region is varied with a movement of the first dielectric member, and an area ratio between the overlapped region and the non-overlapped region in the third region is varied with a movement of the second dielectric member.

In another aspect of the phase shift circuit of the present invention, a moving mechanism for integrally moving the first dielectric member and the second dielectric member is provided.

The antenna device of the present invention includes: a plurality of phase shift circuits to which distributed signals are respectively input; and a plurality of antenna elements to which signals output from the respective phase shift circuits are input. Also, at least one of the plurality of phase shift circuits has a signal line in which a first region in which a first dielectric member is disposed, a second region in which no dielectric member is disposed and a third region in which a second dielectric member is disposed are provided in this order along a propagation direction of a signal. Furthermore, a characteristic impedance of the first region where the first dielectric member is not disposed and a characteristic impedance of the third region where the second dielectric member is not disposed are higher than a characteristic impedance of the second region.

In one aspect of the antenna device of the present invention, the first region and the third region in the signal line have a width smaller than a width of the second region.

In another aspect of the antenna device of the present invention, the first region and the third region in the signal line have a thickness larger than a thickness of the second region.

In another aspect of the antenna device of the present invention, the first dielectric member and the second dielectric member are movable in a direction intersecting with the signal line. The first region includes an overlapped region that is overlapped with the first dielectric member and a non-overlapped region that is not overlapped with the first dielectric member. Also, the third region includes an overlapped region that is overlapped with the second dielectric member and a non-overlapped region that is not overlapped with the second dielectric member. Then, an area ratio between the overlapped region and the non-overlapped region in the first region is varied with a movement of the first dielectric member, and an area ratio between the overlapped region and the non-overlapped region in the third region is varied with a movement of the second dielectric member.

In another aspect of the antenna device of the present invention, a moving mechanism for integrally moving the first dielectric member and the second dielectric member is provided.

According to the present invention, it is possible to realize an antenna device in which the amount of change in the tilt angle relative to the amount of movements of the dielectric members provided in the phase shift circuit is not dependent or less dependent on the frequency of an input signal.

BRIEF DESCRIPTIONS OF THE DRAWINGS

Figure 1:
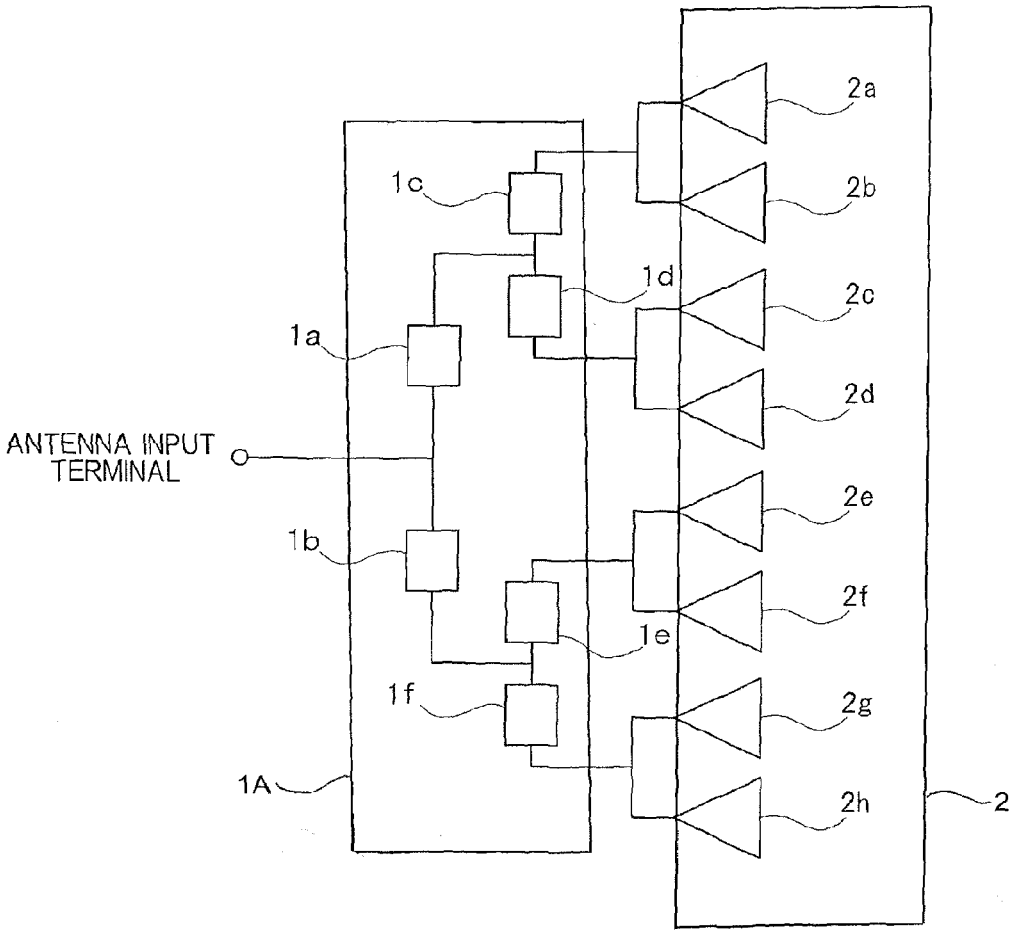
FIG. 1 is a schematic diagram showing a configuration of a base-station antenna device according to the first embodiment.
Figure 7:
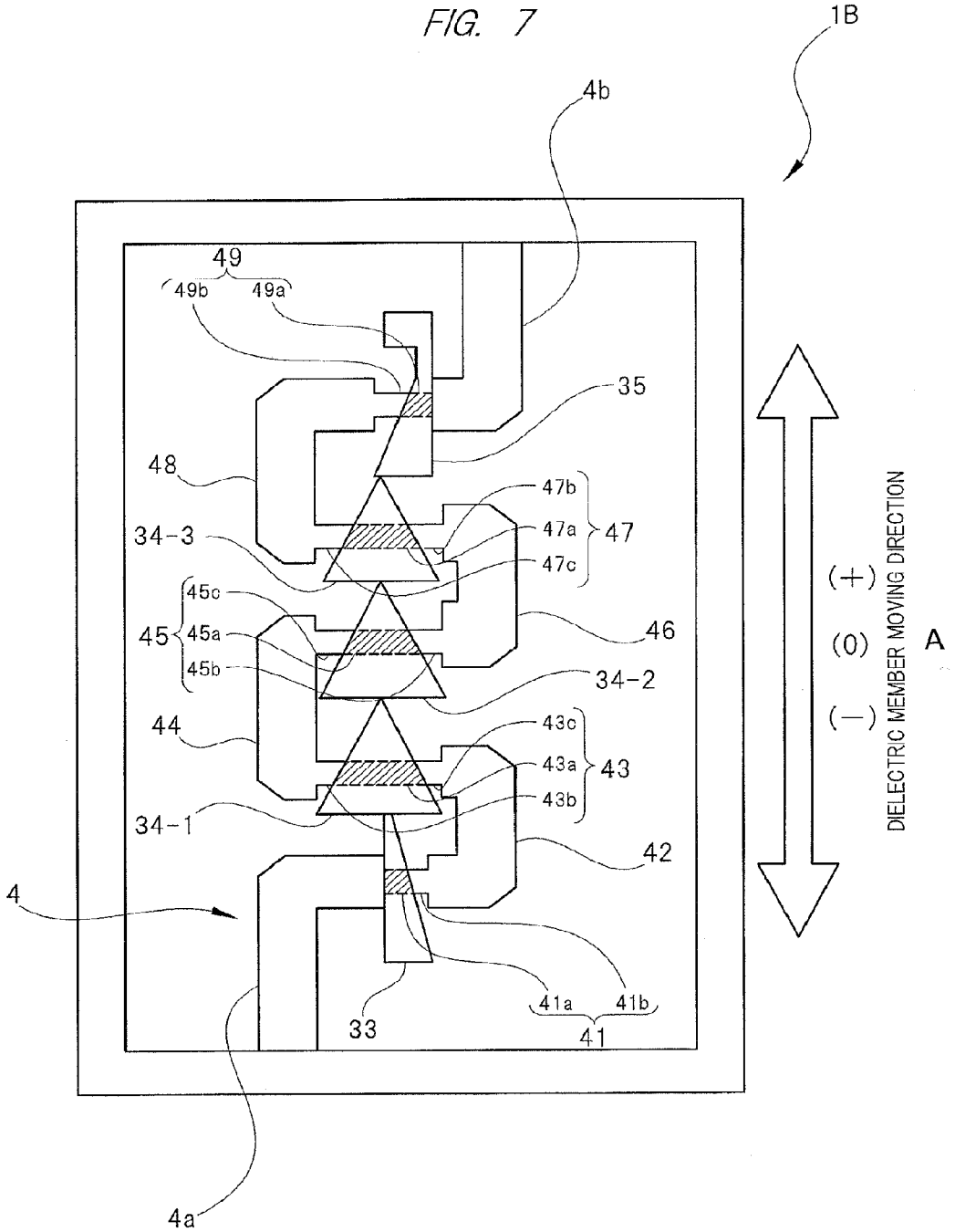
FIG. 7 is a plan view showing a structure of a phase shift circuit according to the second embodiment.
Figure 8:
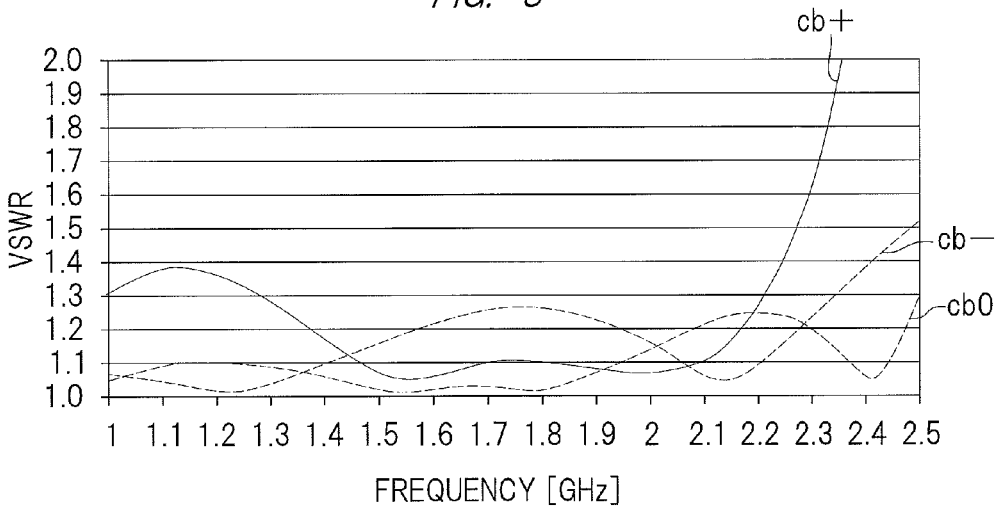
Figure 9:
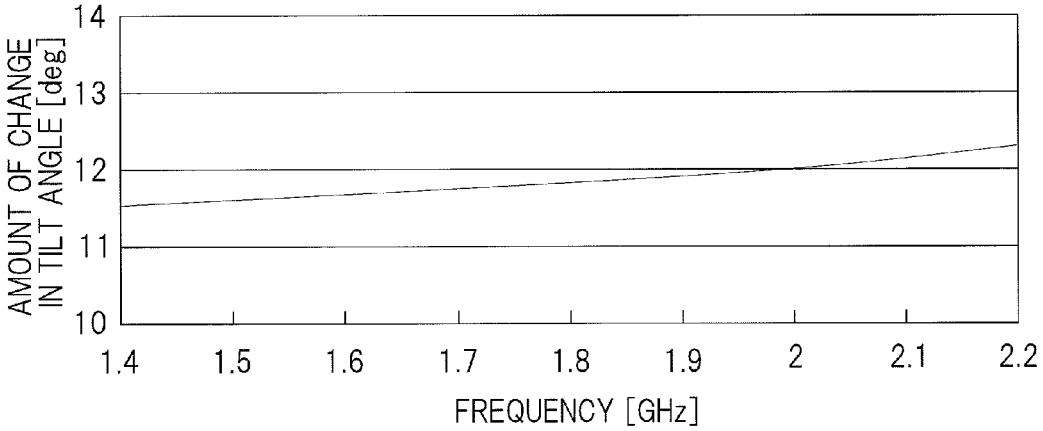

FIG. 8 is a characteristic graph showing a relationship between the frequency and VSWR (Voltage Standing Wave Ratio) as a result of the simulation relating to the phase shift circuit having the structure shown in FIG. 7; and FIG. 9 is a characteristic graph showing a simulation result in the case where the phase shift circuit having the structure shown in FIG. 7 is used as a phase shift circuit of the base-station antenna device shown in FIG. 1.

DETAILED DESCRIPTION OF THE PREFERRED EMBODIMENTS

Hereinafter, some embodiments of the present invention will be described. In the embodiments described below, the invention will be described in a plurality of sections or embodiments when required as a matter of convenience. However, these sections or embodiments are not irrelevant to each other unless otherwise stated, and relate to each other as a modification example, details, or a supplementary explanation thereof. Also, in the embodiments described below, when referring to the number of elements (including number of pieces, values, amount, range, and the like), the number of the elements is not limited to a specific number unless otherwise stated or where the number is apparently limited to a specific number in principle, and the number of elements may be larger or smaller than the specified number.

Further, in the embodiments described below, it goes without saying that the components (including element steps) are not always indispensable unless otherwise stated or where the components are apparently indispensable in principle. Similarly, in the embodiments described below, when the shape of the components, positional relation thereof, and the like are mentioned, the substantially approximate and similar shapes and the like are included therein unless otherwise stated or where it is conceivable that they are apparently eliminated in principle. The same goes for the numerical value and the range described above.

Also, components having the same function are denoted by the same reference characters throughout the drawings for describing the embodiments, and the repetitive description thereof will be omitted.

First Embodiment

The first embodiment of the present invention will be described with reference to FIGS. 1, 2, 3A-3C and 4-6. In this case, a base-station antenna device and a phase shift circuit used in this base-station antenna device will be described.

<Configuration of Base-Station Antenna Device>

FIG. 1 is a schematic diagram showing a configuration of a base-station antenna device according to the first embodiment. The base-station antenna device shown in FIG. 1 is provided with an antenna input terminal, six phase shift circuits 1*a*, 1*b*, 1*c*, 1*d*, 1*e* and 1*f* (collectively referred to also as "phase shift circuits 1A") and eight antenna elements 2*a*, 2*b*, 2*c*, 2*d*, 2*e*, 2*f*, 2*g* and 2*h* (collectively referred to also as "antenna elements 2").

A radio frequency signal output from a radio frequency circuit or the like (not shown) is input to the antenna input terminal shown in FIG. 1. As shown in FIG. 1, the phase shift circuits 1*a*, 1*b*, 1*c*, 1*d*, 1*e* and 1*f* and the antenna elements 2*a*, 2*b*, 2*c*, 2*d*, 2*e*, 2*f*, 2*g* and 2*h* are connected to the antenna input terminal in a hierarchical manner. More specifically, the plurality of phase shift circuits 1A and antenna elements 2 are connected to one after another so as to be expanded from the antenna input terminal. Signals input to the antenna input terminal are distributed and input to the predetermined phase shift circuits 1A, and then input to the predetermined antenna elements 2.

Specifically, the input terminals of the phase shift circuits 1*a* and 1*b* are connected to the antenna input terminal in parallel with each other, the input terminals of the phase shift circuits 1*c* and 1*d* are connected to the output terminal of the phase shift circuit 1*a* in parallel with each other, and the input terminals of the phase shift circuits 1*e* and 1*f* are connected to the output terminal of the phase shift circuit 1*b* in parallel with each other. Therefore, signals input to the antenna input terminal are distributed and respectively input to the two phase shift circuits 1*a* and 1*b*. The signals output from the phase shift circuit 1*a* are further distributed and respectively input to the two phase shift circuits 1*c* and 1*d*. Moreover, the signals output from the phase shift circuit 1*b* are further distributed and respectively input to the two phase shift circuits 1*e* and 1*f*.

The antenna elements 2*a* and 2*b* are connected to the output terminal of the phase shift circuit 1*c* in parallel with each other, and the antenna elements 2*c* and 2*d* are connected to the output terminal of the phase shift circuit 1*d* in parallel with each other. In the same manner, the antenna elements 2*e* and 2*f* are connected to the output terminal of the phase shift circuit 1*e* in parallel with each other, and the antenna elements 2*g* and 2*h* are connected to the output terminal of the phase shift circuit 1*f* in parallel with each other. Therefore, the signals output from the phase shift circuit 1*c* are distributed and respectively input to the two antenna elements 2*a* and 2*b*. The signals output from the phase shift circuit 1*d* are distributed and respectively input to the two antenna elements 2*c* and 2*d*. The signals output from the phase shift circuit 1*e* are distributed and respectively input to the two antenna elements 2*e* and 2*f*. The signals output from the phase shift circuit 1*f* are distributed and respectively input to the two antenna elements 2*g* and 2*h*. In the above-mentioned processes, the respective phase shift circuits 1A change the phases of the input signals and then output the resulting signals to the respective antenna elements 2. In this manner, a base-station antenna device having a predetermined directivity can be realized.

The phase shift circuits 1A and the antenna elements 2 are housed in, for example, an antenna main body having a cylindrical shape. Specifically, the phase shift circuits 1A and the antenna elements 2 are housed in the antenna main body so that the eight antenna elements 2 are arranged in a row along the longitudinal direction of the antenna main body. For example, the antenna elements 2*a*, 2*b*, 2*c*, 2*d*, 2*e*, 2*f*, 2*g* and 2*h* are arranged in a row along the longitudinal direction of the antenna main body in this order from above. Then, the phases of the signals input to the respective antenna elements 2 are gradually delayed in accordance with the order of arrangement of the antenna elements 2. Namely, the phase of the signal input to the antenna element 2*a* disposed at the uppermost position is advanced most, and the phase of the signal input to the antenna element 2*h* disposed at the lowermost position is delayed most. Thus, radio waves to be emitted from the base-station antenna device are tilted downward. Note that the base-station antenna device is generally installed at a high position, and exchanges radio waves with a plurality of mobile phones and the like located below. Therefore, radio waves emitted from the base-station antenna device are tilted downward from the horizontal plane in general.

<Structure of Phase Shift Circuit>

Figure 2:
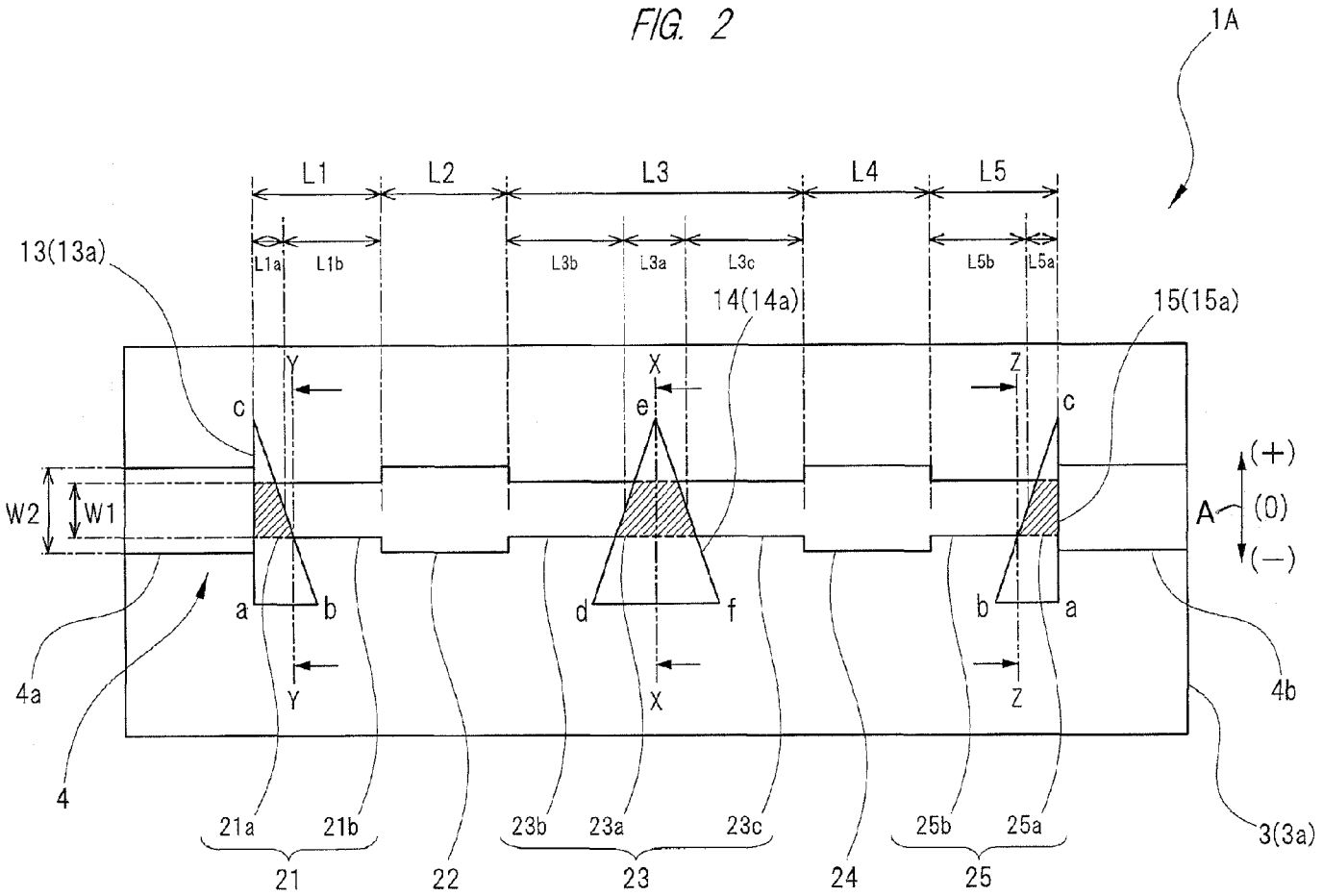
FIG. 2 is a plan view showing a structure of a phase shift circuit used in the base-station antenna device of FIG. 1.
Figure 3A:
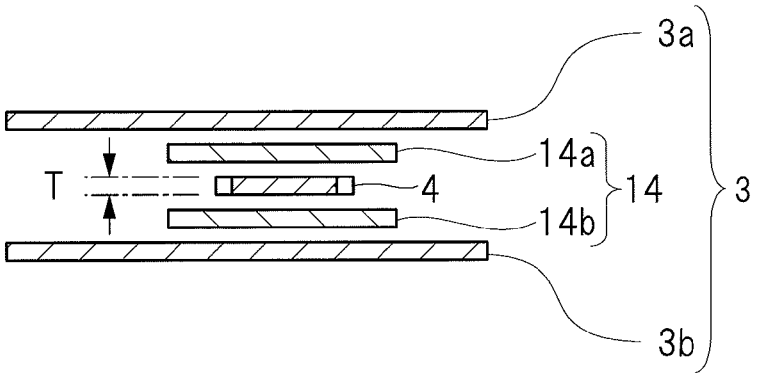
FIG. 3A is a cross-sectional view showing a structure of the phase shift circuit used in the base-station antenna device of FIG. 1 taken along a line X-X in FIG. 2.
Figure 3B:
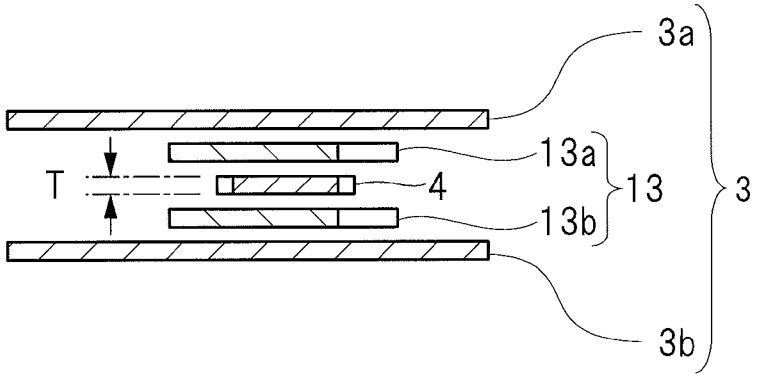
FIG. 3B is a cross-sectional view showing a structure of the phase shift circuit taken along a line Y-Y in FIG. 2.
Figure 3C:
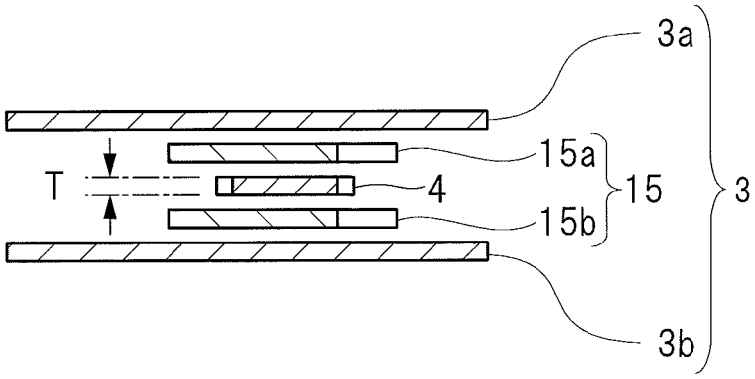
FIG. 3C is a cross-sectional view showing a structure of the phase shift circuit taken along a line Z-Z in FIG. 2.

Next, the structure of the phase shift circuit 1A shown in FIG. 1 will be described with reference to FIG. 2 and FIGS. 3A to 3C. FIG. 2 is a plan view showing the structure of the phase shift circuit 1A. FIG. 3A is a cross-sectional view taken along a line X-X shown in FIG. 2, FIG. 3B is a cross-sectional view taken along a line Y-Y shown in FIG. 2, and FIG. 3C is a cross-sectional view taken along a line Z-Z shown in FIG. 2. Note that all of the phase shift circuits 1*a* to 1*f* shown in FIG. 1 may have the structure shown in FIG. 2 and FIGS. 3A to 3C, or some of the phase shift circuits 1*a* to 1*f* may have the structure shown in FIG. 2 and FIGS. 3A to 3C.

The phase shift circuit 1A shown FIG. 2 is provided with a signal line 4, three paired dielectric members 13, 14 and 15 disposed on the signal line 4 along the propagation direction of signals, and one paired ground conductors 3 that are opposed to each other with the signal line 4 and the paired dielectric members 13, 14 and 15 interposed therebetween. Each of the paired dielectric members 13, 14 and 15 is made up of a dielectric plate that is opposed to the first main surface of the signal line 4 and a dielectric plate that is opposed to the second main surface of the signal line 4. These three paired dielectric members 13, 14 and 15 are allowed to move integrally in a direction parallel with the line width direction (i.e., direction orthogonal to the line length direction). Moreover, although not shown, the paired ground conductors 3 are connected to the ground voltage.

As shown in FIG. 2 and FIG. 3A, the paired dielectric members 14 have a dielectric plate 14*a* and a dielectric plate 14*b* (FIG. 3A) that form the pair. The dielectric plate 14*a* and the dielectric plate 14*b* have the same planar shape, and are opposed to each other with the signal line 4 interposed therebetween. Specifically, as shown in FIG. 3A, the dielectric plate 14*a* is opposed to the first main surface of the signal line 4, and the dielectric plate 14*b* is opposed to the second main surface of the signal line 4. Note that, since the dielectric plate 14*a* and the dielectric plate 14*b* having the same planar shape are disposed so as to be overlapped with each other, only the dielectric plate 14*a* appears in FIG. 2.

As shown in FIG. 2 and FIG. 3B, the paired dielectric members 13 have a dielectric plate 13*a* and a dielectric plate 13*b* (FIG. 3B) that form the pair. The dielectric plate 13*a* and the dielectric plate 13*b* have the same planar shape, and are opposed to each other with the signal line 4 interposed therebetween. Specifically, as shown in FIG. 3B, the dielectric plate 13*a* is opposed to the first main surface of the signal line 4, and the dielectric plate 13*b* is opposed to the second main surface of the signal line 4. For the same reason as described above, only the dielectric plate 13*a* appears in FIG. 2.

As shown in FIG. 2 and FIG. 3C, the paired dielectric members 15 have a dielectric plate 15*a* and a dielectric plate 15*b* (FIG. 3C) that form the pair. The dielectric plate 15*a* and the dielectric plate 15*b* have the same planar shape, and are opposed to each other with the signal line 4 interposed therebetween. Specifically, as shown in FIG. 3C, the dielectric plate 15*a* is opposed to the first main surface of the signal line 4, and the dielectric plate 15*b* is opposed to the second main surface of the signal line 4. For the same reason as described above, only the dielectric plate 15*a* appears in FIG. 2.

In the present embodiment, the dielectric plate 14*a* and the dielectric plate 14*b* form a substantially isosceles triangle when seen in a plan view. Moreover, each of the dielectric plates 13*a*, 13*b*, 15*a* and 15*b* forms a substantially right-angled triangle when seen in a plan view in FIG. 2. Specifically, as shown in FIG. 2, the dielectric plates 13*a* and 13*b* and the dielectric plates 15*a* and 15*b* form a substantially right-angled triangle with apexes a, b and c when seen in a plan view in FIG. 2. In the following description, a side connecting the apex c and the apex b is referred to as "hypotenuse", a side connecting the apex a and the apex c is referred to as "long adjacent side" and a side connecting the apex a and the apex b is referred to as "short adjacent side". Moreover, the dielectric plates 14*a* and 14*b* form a substantially isosceles triangle with apexes d, e and f when seen in a plan view. In the following description, a side connecting the apex d and the apex e is referred to as "first oblique side", a side connecting the apex e and the apex f is referred to as "second oblique side" and a side connecting the apex d and the apex f is referred to as "short side".

As shown in FIG. 2 and FIGS. 3A and 3B, the paired ground conductors 3 have a ground conductor plate 3*a* and a ground conductor plate 3*b* (FIGS. 3A and 3B) opposed to each other. The ground conductor plate 3*a* covers the first main surface of the signal line 4 and the respective main surfaces of the dielectric plates 13*a*, 14*a* and 15*a*. On the other hand, the ground conductor plate 3*b* covers the second main surface of the signal line 4 and the respective main surfaces of the dielectric plates 13*b*, 14*b* and 15*b*. Note that, since the ground conductor plate 3*a* and the ground conductor plate 3*b* having the same planar shape are disposed so as to be overlapped with each other, only the ground conductor plate 3*a* appears in FIG. 2.

As shown in FIG. 3A, a gap is provided between the signal line 4 and each of the dielectric plates 14*a* and 14*b*. Moreover, as shown in FIG. 3B and FIG. 3C, a gap is provided also between the signal line 4 and each of the dielectric plates 13*a* and 13*b*, and a gap is provided also between the signal line 4 and each of the dielectric plates 15*a* and 15*b*, respectively. More specifically, the signal line 4 is electrically separated from each of the paired dielectric members 13, 14 and 15.

As shown in FIG. 2, an input terminal 4*a* to which a signal is input is formed at one end of the signal line 4, and an output terminal 4*b* from which a signal is output is formed at the other end thereof. In the present embodiment, the signal line 4 extends linearly when seen in a plan view, but the planar shape of the signal line 4 is not limited to the shape shown in FIG. 2. For example, the signal line 4 may extend from the input terminal 4*a* to the output terminal 4*b* in a zigzag manner. In the signal line 4 shown in FIG. 2, a first region 21, a second region 22, a third region 23, a fourth region 24 and a fifth region 25 are formed between the input terminal 4*a* and the output terminal 4*b* in this order along the propagation direction of the signal.

The paired dielectric members 13 are disposed in the first region 21 of the signal line 4, the paired dielectric members 14 are disposed in the third region 23 of the signal line 4, and the paired dielectric members 15 are disposed in the fifth region 25 of the signal line 4. Therefore, the first region 21 includes an overlapped region 21*a* that is overlapped with the paired dielectric members 13 (dielectric plates 13*a* and 13*b*) and a non-overlapped region 21*b* that is not overlapped with the paired dielectric members 13 (dielectric plates 13*a* and 13*b*). Also, the third region 23 includes an overlapped region 23*a* that is overlapped with the paired dielectric members 14 (dielectric plates 14*a* and 14*b*) and non-overlapped regions 23*b* and 23*c* that are not overlapped with the paired dielectric members 14 (dielectric plates 14*a* and 14*b*). Furthermore, the fifth region 25 includes an overlapped region 25*a* that is overlapped with the paired dielectric members 15 (dielectric plates 15*a* and 15*b*) and a non-overlapped region 25*b* that is not overlapped with the paired dielectric members 15 (dielectric plates 15*a* and 15*b*). In FIG. 2, in order to clearly indicate the respective overlapped regions 21*a*, 23*a* and 25*a*, these overlapped regions 21*a*, 23*a* and 25*a* are indicated by oblique lines (hatched lines).

More specifically, the dielectric plates 13*a* and 13*b* in the present embodiment correspond to a first dielectric member. Moreover, the dielectric plates 14*a* and 14*b* correspond to a second dielectric member. On the other hand, when seen from a different viewpoint, the dielectric plates 14*a* and 14*b* correspond to a first dielectric member, and the dielectric plates 15*a* and 15*b* correspond to a second dielectric member. In this case, the third region 23 corresponds to a first region, the fourth region 24 corresponds to a second region, and the fifth region 25 corresponds to a third region.

The paired dielectric members 13, 14 and 15 shown in FIG. 2 are moved integrally in a direction parallel with the line width direction by a moving mechanism (not shown). In FIG. 2, the moving direction of the paired dielectric members 13, 14 and 15 is indicated by an arrow A. Also, the positions of the paired dielectric members 13, 14 and 15 shown in FIG. 2 correspond to positions (reference positions) at the time when the amount of movement is 0 (zero). The paired dielectric members 13, 14 and 15 are moved from the reference positions in a +A direction or a −A direction by the moving mechanism. With the movement of the paired dielectric members 13, the area ratio between the overlapped region 21*a* and the non-overlapped region 21*b* in the first region 21 is varied. Moreover, with the movement of the paired dielectric members 14, the area ratio between the overlapped region 23*a* and the non-overlapped regions 23*b* and 23*c* in the third region 23 is varied. Furthermore, with the movement of the paired dielectric members 15, the area ratio between the overlapped region 25*a* and the non-overlapped region 25*b* in the fifth region 25 is varied. For example, when the paired dielectric members 13 shown in FIG. 2 are moved in the +A direction, the area of the overlapped region 21*a* in the first region 21 increases, while the area of the non-overlapped region 21*b* therein decreases. On the other hand, when the paired dielectric members 13 shown in FIG. 2 are moved in the −A direction, the area of the overlapped region 21*a* in the first region 21 decreases, while the area of the non-overlapped region 21*b* therein increases.

Each of the first region 21, the third region 23 and the fifth region 25 of the signal line 4 shown in FIG. 2 has a predetermined first width (W1). Also, each of the input terminal 4*a*, the second region 22, the fourth region 24 and the output terminal 4*b* of the signal line 4 has a predetermined second width (W2). In this case, the first width (W1) is smaller than the second width (W2). Namely, the width of each of the first region 21, the third region 23 and the fifth region 25 is smaller than the width of each of the input terminal 4*a*, the second region 22, the fourth region 24 and the output terminal 4*b*. In other words, regions having a comparatively larger width and regions having a comparatively smaller width are alternately formed in the signal line 4 along the propagation direction of signals.

Meanwhile, as shown in FIG. 3A to FIG. 3C, the thickness (T) of the signal line 4 is uniform. More specifically, the thickness (T) of each of the input terminal 4*a*, the first region 21, the second region 22, the third region 23, the fourth region 24, the fifth region 25 and the output terminal 4*b* shown in FIG. 2 is the same.

Also, the length (L1) of the first region 21 corresponds to the sum of the length (L1*a*) of the overlapped region 21*a* and the length (L1*b*) of the non-overlapped region 21*b*. The length (L3) of the third region 23 corresponds to the sum of the length (L3*a*) of the overlapped region 23*a*, the length (L3*b*) of the non-overlapped region 23*b* and the length (L3*c*) of the non-overlapped region 23*c*. Furthermore, the length (L5) of the fifth region 25 corresponds to the sum of the length (L5*a*) of the overlapped region 25*a* and the length (L5*b*) of the non-overlapped region 25*b*. In the present embodiment, the length (L1*a*, L5*a*) at the time when the paired dielectric members 13, 14 and 15 are located at the reference positions is about 7.5 mm, and the length (L1*b*, L5*b*) is about 0.2 mm. Moreover, the length (L3*b*, L3*c*) is about 0.2 mm, and the length (L3*a*) is about 17.0 mm. Furthermore, the length (L2) of the second region 22 and the length (L4) of the fourth region 24 are about 13.7 mm. In this case, the length of each of the regions is a length measured at the center of the signal line 4 in the width direction.

Each of the paired dielectric members 13, 14 and 15 is allowed to move by about 6 mm in the +A direction and by about 6 mm in the −A direction from the reference position shown in FIG. 2. More specifically, the movable range of the paired dielectric members 13, 14 and 15 is about +6 mm and −6 mm from the reference position shown in FIG. 2.

In the present embodiment, the length (L1) of the first region 21 is substantially the same as the length (length of line segment a-b) of the short adjacent side of the dielectric plates 13*a* and 13*b*. Also, the length (L5) of the fifth region 25 is substantially the same as the length (length of line segment a-b) of the short adjacent side of the dielectric plates 15*a* and 15*b*. Furthermore, the length (L3) of the third region 23 is substantially the same as the length (length of line segment d-f) of the short side of the dielectric plates 14*a* and 14*b*. Note that the scale in FIG. 2 is not necessarily coincident with the magnitude of the above-mentioned numeric values for the reason of illustration.

The signal line 4 is made of, for example, a metal material such as copper. The dielectric plates 13*a*, 13*b*, 14*a*, 14*b*, 15*a* and 15*b* are made of, for example, a resin material such as glass epoxy. The ground conductor plates 3*a* and 3*b* are made of, for example, a metal material such as copper. The dielectric constant $\in$ of each of the dielectric plates 13*a*, 13*b*, 14*a*, 14*b*, 15*a* and 15*b* is, for example, 4.0, and the dielectric tangent tan $\delta$ thereof is, for example, 0.002.

Figure 4:
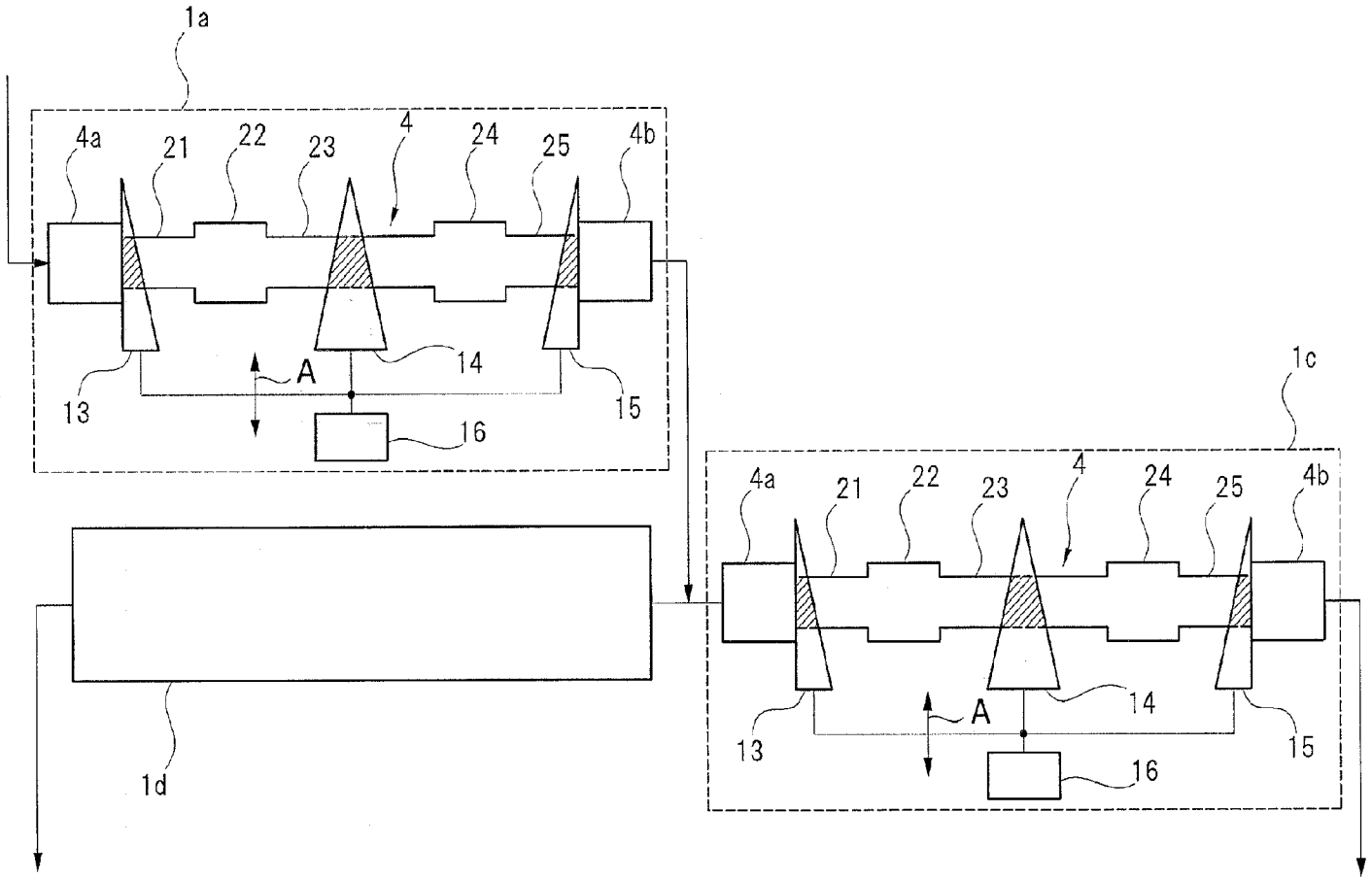
FIG. 4 is a plan view showing a structure of the phase shift circuit used in the base-station antenna device of FIG. 1.

FIG. 4 is a plan view showing a configuration example of a base-station antenna device using the phase shift circuits 1A shown in FIG. 2. In the base-station antenna device shown in FIG. 4, the phase shift circuits 1A shown in FIG. 2 are used as phase shift circuits 1*a* and 1*c* shown in FIG. 1. In FIG. 4, since the same components as those of FIGS. 1, 2 and 3A to 3C are denoted by the same reference characters, only different components will be described below.

In the configuration shown in FIG. 4, a moving mechanism 16 connected to the paired dielectric members 13, 14 and 15 is provided. This moving mechanism 16 moves the paired dielectric members 13, 14 and 15 in the phase shift circuits 1*a* and 1*c* of FIG. 1 by a specified distance in the arrow A direction. When the paired dielectric members 13, 14 and 15 are moved by the moving mechanism 16, the overlapped area between the signal line 4 and the paired dielectric members 13, 14 and 15 is varied in each of the phase shift circuits 1*a* and 1*c*. Note that the moving mechanism 16 provided in the phase shift circuit 1*a* and the moving mechanism 16 provided in the phase shift circuit 1*b* may be operated in conjunction with each other or may be controlled separately.

The phase shift circuit 1*a* changes the phase of a signal input from the input terminal 4*a*, and outputs the signal whose phase has been changed from the output terminal 4*b*. The signals output from the phase shift circuit 1*a* are distributed and respectively input to the two phase shift circuits 1*c* and 1 *d*. The phase shift circuit 1*c* changes the phase of the signal input from the input terminal 4*a*, and outputs the signal whose phase has been changed from the output terminal 4*b* to the antenna elements 2*a* and 2*b* (FIG. 1).

As described above, in the present embodiment, a desired phase is imparted to the signal in each of the plurality of phase shift circuits. The change in phases in each of the phase shift circuits is realized by the overlap (intersection) between the signal line and the paired dielectric members (dielectric plates) in each of the phase shift circuits.

In the phase shift circuit according to the present invention, a plurality of dielectric members that are physically adjacent to each other are disposed on a signal line. In this case, the plurality of dielectric members that are physically adjacent to each other means the plurality of dielectric members disposed on the signal line in one phase shift circuit. For example, the dielectric plates forming the paired dielectric members 13 and the dielectric plates forming the paired dielectric members 14 in the phase shift circuit 1*a* shown in FIG. 4 represent one example of the plurality of dielectric members that are physically adjacent to each other. Similarly, the dielectric plates forming the paired dielectric members 14 and the dielectric plates forming the paired dielectric members 15 in the phase shift circuit 1*a* shown in FIG. 4 represent another example of the plurality of dielectric members that are physically adjacent to each other. On the other hand, dielectric plates forming the paired dielectric members 15 in the phase shift circuit 1*a* and dielectric plates forming the paired dielectric members 13 in another phase shift circuit 1*c* do not correspond to the plurality of dielectric members that are physically adjacent to each other. The length (line length) of the signal line between two dielectric plates physically adjacent to each other in this manner is desirably set to ½ or ¼ of the wavelength of the signal that is propagated through the signal line.

For example, in the phase shift circuit disclosed in the Patent Document 1, one phase shift circuit is made up of one dielectric plate. Therefore, the phase shift circuit disclosed in the Patent Document 1 is not provided with "the plurality of dielectric members that are physically adjacent to each other" described in this specification.

<Description of Operations of Phase Shift Circuit 1A>

Operations of the phase shift circuit 1A will be described in more detail with reference again to FIG. 2. The paired dielectric members 13, 14 and 15 are integrally moved in the +A direction or −A direction by a moving mechanism (not shown).

For example, the paired dielectric members 13, 14 and 15 are moved in the +A direction from the reference position shown in FIG. 2. Thus, the overlapped area between the paired dielectric members 13, 14 and 15 and the signal line 4 is varied (i.e., increased). Specifically, the areas of the overlapped regions 21*a*, 23*a* and 25*a* in the first region 21, the third region 23 and the fifth region 25 increase. When the overlapped area between the paired dielectric members 13, 14 and 15 and the signal line 4 increases, the propagation speed of a signal in the signal line 4 becomes slower. Namely, the phase of the signal is delayed.

On the other hand, when the paired dielectric members 13, 14 and 15 are moved in the −A direction from the reference position shown in FIG. 2, the overlapped area between the paired dielectric members 13, 14 and 15 and the signal line 4 is varied (decreased). Specifically, the areas of the overlapped regions 21*a*, 23*a* and 25*a* in the first region 21, the third region 23 and the fifth region 25 decrease. When the overlapped area between the paired dielectric members 13, 14 and 15 and the signal line 4 decreases, the propagation speed of a signal in the signal line 4 becomes faster. Namely, the phase of the signal is advanced.

As described above, by varying (increasing/decreasing) the overlapped area between the paired dielectric members 13, 14 and 15 and the signal line 4 by moving the paired dielectric members 13, 14 and 15, a desired phase can be given to the input signal.

In the signal line 4 provided in the phase shift circuit 1A of the present embodiment, regions having a large width (input terminal 4*a*, second region 22, fourth region 24) and regions having a small width (first region 21, third region 23, fifth region 25) are alternately formed along the propagation direction of the signal. Moreover, the paired dielectric members 13, 14 and 15 are disposed in the first region 21, the third region 23 and the fifth region 25 each having a small width, respectively.

In this case, when a dielectric member is overlapped with a part of the region of the signal line, the characteristic impedance of the corresponding region is lowered. In other words, the characteristic impedances of the first region 21, the third region 23 and the fifth region 25 shown in FIG. 2 are lowered in comparison with those in a state in which none of the paired dielectric members 13, 14 and 15 is disposed (hereinafter, referred to as "initial state"). Therefore, when the characteristic impedance of the signal line 4 in the initial state is uniform, mismatching occurs between the characteristic impedances of the first region 21, the third region 23 and the fifth region 25 after the paired dielectric members 13, 14 and 15 have been disposed and the characteristic impedances of the second region 22 and the fourth region 24. In other words, between the paired dielectric members 13 and the paired dielectric members 14, a region having a first characteristic impedance (first region 21), a region having a second characteristic impedance (second region 22) higher than the first characteristic impedance and a region having a third characteristic impedance (third region 23) lower than the second characteristic impedance are arranged in this order. Also, between the paired dielectric members 14 and the paired dielectric members 15, a region having the first characteristic impedance (third region 23), a region having the second characteristic impedance (fourth region 24) higher than the first characteristic impedance and a region having the third characteristic impedance (fifth region 25) lower than the second characteristic impedance are arranged in this order. As a result, signal reflection occurs between the paired dielectric members 13 and the paired dielectric members 14, so that the signal phase is delayed. Moreover, signal reflection occurs also between the paired dielectric members 14 and the paired dielectric members 15, so that the signal phase is delayed. Therefore, a phase change caused by the signal reflection is added to the signal output from the output terminal 4*b* in addition to a desired phase change. Moreover, since the value of the characteristic impedance of the signal line 4 differs depending on the frequency of a signal propagated through the signal line 4, the delay in the phase caused by the signal reflection is affected by the frequency of an input signal.

In contrast, in the present embodiment, the widths of the first region 21 where the paired dielectric members 13 are disposed, the third region 23 where the paired dielectric members 14 are disposed and the fifth region 25 where the paired dielectric members 15 are disposed are smaller than the widths of the input terminal 4*a*, the second region 22, the fourth region 24 and the output terminal 4*b* where no paired dielectric members is disposed. More specifically, the characteristic impedances of the first region 21, the third region 23 and the fifth region 25 in the initial state are higher than the characteristic impedances of the input terminal 4*a*, the second region 22, the fourth region 24 and the output terminal 4*b*. In other words, as the characteristic impedances of the first region 21, the third region 23 and the fifth region 25 in the initial state, high characteristic impedances are set in advance in consideration of the reduction of the characteristic impedances due to the installation of the paired dielectric members 13, 14 and 15. Therefore, when the paired dielectric members 13, 14 and 15 are respectively disposed in the first region 21, the third region 23 and the fifth region 25, the mismatching of the characteristic impedances on the signal line 4 is eliminated or reduced, so that the signal reflection caused by the mismatching of the characteristic impedances is suppressed.

As described above, in the present embodiment, regions having a high characteristic impedance and regions having a low characteristic impedance in the initial state are alternately formed on the signal line in the propagation direction of the signal. More specifically, the position where the characteristic impedance in the initial state is changed corresponds to a border between the respective regions on the signal line. Moreover, in the present embodiment in which the region having a high characteristic impedance and the region having a low characteristic impedance in the initial state are formed by making the width of the signal line partially different, the position where the width of the signal line is changed corresponds to a border between the respective regions.

Alternatively, by making the thickness of the signal line partially different, while making the width of the signal line uniform, the region having a high characteristic impedance and the region having a low characteristic impedance in the initial state may be formed. For example, by making the thicknesses of the first region 21, the third region 23 and the fifth region 25 shown in FIG. 2 smaller than the thicknesses of the input terminal 4*a*, the second region 22, the fourth region 24 and the output terminal 4*b*, the region having a high characteristic impedance and the region having a low characteristic impedance in the initial state may be formed. In this case, the position where the thickness of the signal line is changed corresponds to a border between the respective regions.

Although not particularly limited, the characteristic impedance of the input terminal 4*a* and the output terminal 4*b* shown in FIG. 2 is, for example, 50 S), the characteristic impedance of the first region 21, the third region 23 and the fifth region 25 in the initial state is, for example, 65 S), and the characteristic impedance of the second region 22 and the fourth region 24 is, for example, 55Ω.

<Simulation Results of Phase Shift Circuit 1A>

Next, simulation results relating to the phase shift circuit 1A shown in FIG. 2 will be described with reference to FIGS. 5 and 6.

In the following description, in order to indicate the effects of the present invention, simulation results relating to a phase shift circuit (hereinafter, referred to as "comparative object") having a structure different from that of the phase shift circuit 1A shown in FIG. 2 are also described.

The comparative object has the same structure as that of the phase shift circuit 1A shown in FIG. 2 except that the width of the signal line is uniform. Therefore, the structure of the comparative object is described accordingly with reference to FIG. 2. The comparative object has a signal line in which the width of the parts corresponding to the first region 21, the third region 23 and the fifth region 25 shown in FIG. 2 is the same as the width of the parts corresponding to the second region 22 and the fourth region 24 shown in FIG. 2.

In the comparative object, when the two paired dielectric members corresponding to the paired dielectric members 13 and the paired dielectric members 15 shown in FIG. 2 are located at the reference position, the lengths corresponding to the length (L1*a*) and length (L5*a*) shown in FIG. 2 are respectively about 6.4 mm. Also, in the comparative object, when the paired dielectric members corresponding to the paired dielectric members 14 are located at the reference position, the length corresponding to the length (L3*a*) shown in FIG. 2 is about 16.0 mm. Furthermore, a line length (L1*b*+L2+L3*b*) between the two paired dielectric members corresponding to the paired dielectric members 13 and the paired dielectric members 14 is about 18.6 mm. A line length (L3*c*+L4+L5*b*) between the two paired dielectric members corresponding to the paired dielectric members 14 and the paired dielectric members 15 is also about 18.6 mm. Moreover, the characteristic impedance of the signal line in the initial state (state where none of the paired dielectric members is disposed) is 50Ω.

Furthermore, in the comparative object, the three paired dielectric members corresponding to the paired dielectric members 13 to 15 shown in FIG. 2 have the same dielectric constant ∈ and dielectric tangent tan δ as those of the paired dielectric members 13 to 15 shown in FIG. 2.

Figure 5:
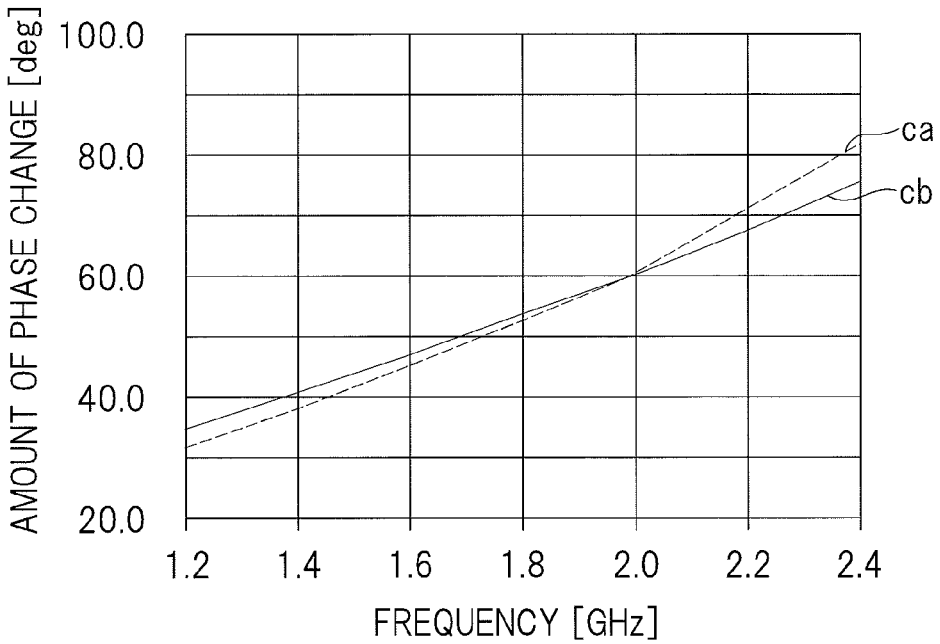
FIG. 5 is a characteristic graph showing a relationship between the frequency and the amount of phase change as a result of the simulation relating to the phase shift circuit having the structure shown in FIG. 2 and FIGS. 3A to 3C.

FIG. 5 is a characteristic graph showing a relationship between the frequency of a signal input to the phase shift circuit 1A and the comparative object and the amount of phase change of the signal input to the phase shift circuit 1A and the comparative object. The axis of abscissas of the graph shown in FIG. 5 represents the frequency in GHz of the input signal, and the axis of ordinate thereof represents the amount of phase change in degrees [deg]. More specifically, the graph in FIG. 5 shows the amount of phase change for each frequency of the input signal at the time when the three paired dielectric members 13 to 15 provided in the phase shift circuit 1A and the three paired dielectric members provided in the comparative object are respectively moved by the same distance. A broken line ca in the graph shows a difference (amount of phase change) between a phase at the time when the three paired dielectric members provided in the comparative object are moved by +6 mm and a phase at the time when they are moved by −6 mm. On the other hand, a solid line cb in the graph shows a difference (amount of phase change) between a phase at the time when the three paired dielectric members 13 to 15 provided in the phase shift circuit 1A are moved by +6 mm and a phase at the time when they are moved by −6 mm.

As shown in FIG. 5, in the phase shift circuit 1A, when the frequency of an input signal is changed from 1.2 GHz to 2.4 GHz, the amount of phase change is almost linearly changed from about 35 degrees to about 75 degrees. In contrast, the amount of phase change in the comparative object is curvilinearly changed from about 31 degrees to about 82 degrees.

Figure 6:
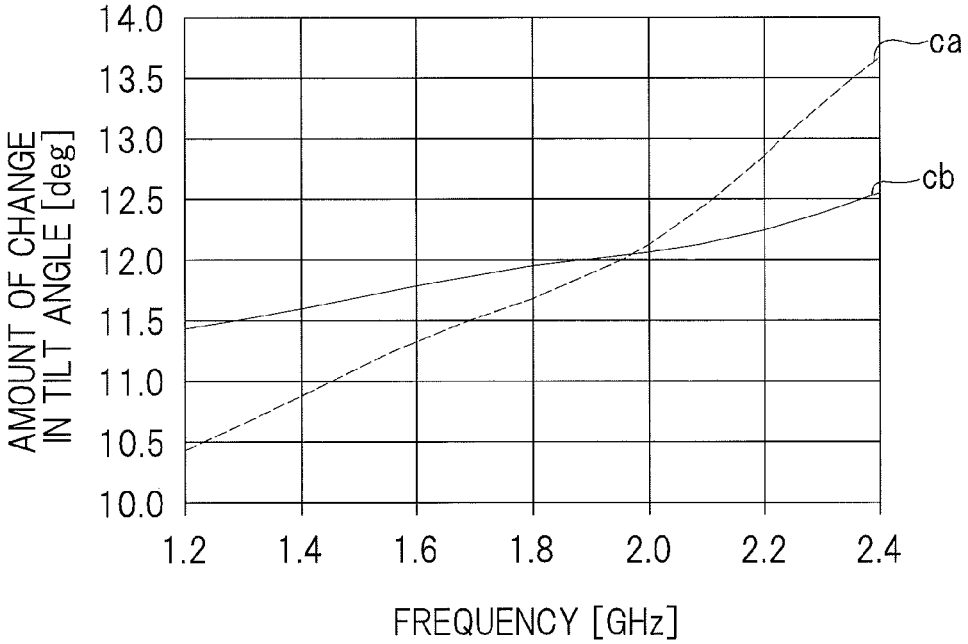
FIG. 6 is a characteristic graph showing a relationship between the frequency and the amount of change in tilt angle as a result of the simulation relating to the base-station antenna device and the phase shift circuit having the structure shown in FIGS. 1, 2 and 3A to 3C.

FIG. 6 is a characteristic graph showing a relationship between the frequency of an input signal and the amount of change in tilt angle. The axis of abscissas of the graph shown in FIG. 6 represents the frequency in GHz of a signal input to a base-station antenna device, and the axis of ordinate thereof represents the amount of change in tilt angle in degrees [deg] of a radio wave emitted from the base-station antenna device. More specifically, the graph in FIG. 6 shows the amount of change in tilt angle for each frequency of the input signal at the time when the paired dielectric members provided in the phase shift circuits serving as the phase shift circuits 1*a* to 1*f* shown in FIG. 1 are moved. A broken line ca in the graph shows a characteristic when the comparative object is used as each of the phase shift circuits 1*a* to 1*f* shown in FIG. 1, and a solid line cb shows a characteristic when the phase shift circuit 1A is used as each of the phase shift circuits 1*a* to 1*f* shown in FIG. 1. Specifically, the broken line ca indicates a difference (amount of change in tilt angle) between the tilt angle at the time when the three paired dielectric members provided in the comparative object serving as each of the phase shift circuits 1*a* to 1*f* are moved by +6 mm and the tilt angle at the time when they are moved by −6 mm. On the other hand, the solid line cb indicates a difference (amount of change in tilt angle) between the tilt angle at the time when the three paired dielectric members 13 to 15 provided in the phase shift circuit 1A serving as each of the phase shift circuits 1*a* to 1*f* are moved by +6 mm and the tilt angle at the time when they are moved by −6 mm.

The amount of change in tilt angle is desirably maintained at about 12 degrees irrespective of the frequency of the input signal. However, as shown in FIG. 6, in the case where the comparative object is used as each of the phase shift circuits 1*a* to 1*f* shown in FIG. 1, when the frequency of the input signal is changed from 1.2 GHz to 2.4 GHz, the amount of change in tilt angle is greatly changed from about 10.5 degrees to about 13.7 degrees. On the other hand, in the case where the phase shift circuit 1A is used as each of the phase shift circuits 1*a* to 1*f* shown in FIG. 1, even when the frequency of the input signal is changed from 1.2 GHz to 2.4 GHz, the amount of change in tilt angle is maintained within a range from about 11.5 degrees to about 12.5 degrees. Namely, the frequency dependence of the amount of change in tilt angle with respect to the amount of movement of the paired dielectric members is lowered. Thus, in the frequency range from 1.2 GHz to 2.4 GHz, the amount of change in tilt angle of a radio wave emitted from the base-station antenna device can be maintained at the desired amount of change in tilt angle (about 12 degrees).

Note that the expression of the amount of change in tilt angle is used in the description above. However, from the viewpoint of positively changing the tilt angle, the expression of the variable amount of tilt angle may be used instead.

Second Embodiment

FIG. 7 is a plan view showing a structure of a phase shift circuit 1B according to the second embodiment. In the present embodiment, the signal line 4 extends from the input terminal 4*a* to the output terminal 4*b*, while being bent to form a series of U shaped portions. In the present embodiment, five paired dielectric members 33, 34-1, 34-2, 34-3 and 35 are disposed on the signal line 4. The paired dielectric members 33 of the present embodiment correspond to the paired dielectric members 13 in the first embodiment. Similarly, the paired dielectric members 34-1, 34-2 and 34-3 correspond to the paired dielectric members 14, and the paired dielectric members 35 correspond to the paired dielectric members 15. Namely, in the phase shift circuit 1B of the present embodiment, three paired dielectric members each corresponding to the paired dielectric members 14 in the first embodiment are provided.

In the present embodiment, the paired dielectric members 33 are disposed in a first region 41 on the signal line 4, the paired dielectric members 34-1 are disposed in a third region 43, the paired dielectric members 34-2 are disposed in a fifth region 45, the paired dielectric members 34-3 are disposed in a seventh region 47, and the paired dielectric members 35 are disposed in a ninth region 49.

Therefore, the first region 41 includes an overlapped region 41*a* that is overlapped with the dielectric plates forming the paired dielectric members 33 and a non-overlapped region 41*b* that is not overlapped with the dielectric plates forming the paired dielectric members 33. The third region 43 includes an overlapped region 43*a* that is overlapped with the dielectric plates forming the paired dielectric members 34-1 and non-overlapped regions 43*b* and 43*c* that are not overlapped with the dielectric plates forming the paired dielectric members 34-1. The fifth region 45 includes an overlapped region 45*a* that is overlapped with the dielectric plates forming the paired dielectric members 34-2 and non-overlapped regions 45*b* and 45*c* that are not overlapped with the dielectric plates forming the paired dielectric members 34-2. The seventh region 47 includes an overlapped region 47*a* that is overlapped with the dielectric plates forming the paired dielectric members 34-3 and non-overlapped regions 47*b* and 47*c* that are not overlapped with the dielectric plates forming the paired dielectric members 34-3. Moreover, the ninth region 49 includes an overlapped region 49*a* that is overlapped with the dielectric plates forming the paired dielectric members 35 and a non-overlapped region 49*b* that is not overlapped with the dielectric plates forming the paired dielectric members 35. In FIG. 7, in order to clearly indicate the respective overlapped regions 41*a*, 43*a*, 45*a*, 47*a* and 49*a*, these overlapped regions 41*a*, 43*a*, 45*a*, 47*a* and 49*a* are indicated by oblique lines (hatched lines).

The paired dielectric members 33, 34-1 to 34-3 and 35 shown in FIG. 7 are allowed to move integrally in a longitudinal direction on the drawing surface (i.e., dielectric member moving direction A). More specifically, the paired dielectric members 33, 34-1 to 34-3 and 35 integrally move upward or downward on the drawing surface of FIG. 7. The positions of the paired dielectric members 33, 34-1 to 34-3 and 35 shown in FIG. 7 correspond to positions (reference positions) at the time when the amount of movement is 0 (zero). When the paired dielectric members 33, 34-1 to 34-3 and 35 are moved upward from the reference positions shown in FIG. 7, the overlapped areas between the signal line 4 and the respective paired dielectric members 33, 34-1 to 34-3 and 35 increase, and when they are moved downward, the overlapped areas decrease. In other words, in the respective regions where the dielectric members are disposed, the area ratio between the overlapped areas and the non-overlapped areas is varied.

Also in the present embodiment, the width of a region including the overlapped region between the paired dielectric members and the signal line is smaller than the width of regions ahead of and behind the above-mentioned region like the first embodiment. Specifically, the width of the first region 41 in which the paired dielectric members 33 are disposed is smaller than the width of the input terminal 4*a* and the second region 42. Similarly, the width of the third region 43 in which the paired dielectric members 34-1 are disposed is smaller than the width of the second region 42 and the fourth region 44. The width of the fifth region 45 in which the paired dielectric members 34-2 are disposed is smaller than the width of the fourth region 44 and the sixth region 46. The width of the seventh region 47 in which the paired dielectric members 34-3 are disposed is smaller than the width of the sixth region 46 and the eighth region 48. The width of the ninth region 49 in which the paired dielectric members 35 are disposed is smaller than the width of the eighth region 48 and the output terminal 4*b*. Namely, characteristic impedances of the first region 41, the third region 43, the fifth region 45, the seventh region 47 and the ninth region 49 in the initial state are higher than the characteristic impedances of the input terminal 4*a*, the second region 42, the fourth region 44, the sixth region 46, the eighth region 48 and the output terminal 4*b*. In other words, as the characteristic impedances of the first region 41, the third region 43, the fifth region 45, the seventh region 47 and the ninth region 49, high characteristic impedances are set in advance in consideration of the reduction of the characteristic impedances due to the installation of the paired dielectric members 33, 34-1 to 34-3 and 35. Therefore, when the paired dielectric members 33, 34-1 to 34-3 and 35 are respectively disposed in the first region 41, the third region 43, the fifth region 45, the seventh region 47 and the ninth region 49, the mismatching of the characteristic impedances on the signal line 4 is eliminated or reduced, so that the signal reflection caused by the mismatching of the characteristic impedances is suppressed.

Next, simulation results relating to the phase shift circuit 1B shown in FIG. 7 will be described with reference to FIG. 8. FIG. 8 is a characteristic graph showing the characteristic of the phase shift circuit 1B shown in FIG. 7 obtained by the simulation. Specifically, the graph shown in FIG. 8 indicates a relationship between the frequency of a signal input to the phase shift circuit 1B and VSWR (Voltage Standing Wave Ratio). The axis of abscissas of the graph represents the frequency in GHz of the input signal and the axis of ordinate thereof represents VSWR. Moreover, a broken line cb0 in the graph shows a characteristic when the paired dielectric members 33, 34-1 to 34-3 and 35 shown in FIG. 7 are located at the reference positions. On the other hand, a solid line cb+ and a broken line cb− in the graph show characteristics when the paired dielectric members 33, 34-1 to 34-3 and 35 shown in FIG. 7 are moved from the reference positions. Specifically, the solid line cb+ indicates a characteristic at the time when the paired dielectric members 33, 34-1 to 34-3 and 35 are moved by +6 mm corresponding to the maximum moving distance in the positive direction. Moreover, the broken line cb− indicates a characteristic at the time when the paired dielectric members 33, 34-1 to 34-3 and 35 are moved by −6 mm corresponding to the maximum moving distance in the negative direction.

In this simulation, the value of VSWR is obtained while changing the frequency of the input signal from 1.0 GHz to 2.5 GHz. In the case where the paired dielectric members 33, 34-1 to 34-3 and 35 shown in FIG. 7 are located at the reference positions shown in FIG. 7, the VSWR is maintained at 1.3 or less within the range of the frequency of the input signal from about 1.0 GHz to 2.5 GHz. Moreover, in the case where the paired dielectric members 33, 34-1 to

34-3 and 35 are moved by +6 mm, the VSWR is maintained at 1.3 or less within the range of the frequency of the input signal from about 1.3 GHz to about 2.2 GHz. Furthermore, in the case where the paired dielectric members 33, 34-1 to 34-3 and 35 are moved by −6 mm, the VSWR is maintained at 1.3 or less within the range of the frequency of the input signal from 1.0 GHz to about 2.3 GHz. In particular, when the frequency band of the input signal is 1.5 GHz band or 2 GHz band, the VSWR is maintained at 1.22 or less irrespective of the positions of the paired dielectric members 33, 34-1 to 34-3 and 35, and the state close to a resonant state can be achieved.

FIG. 9 is a characteristic graph showing a relationship between the frequency of an input signal and the amount of change in tilt angle in degrees [deg]. Specifically, the axis of abscissas of the graph shown in FIG. 9 represents the frequency in GHz of the input signal, and the axis of ordinate thereof represents the amount of change in tilt angle. In other words, the graph in FIG. 9 shows the amount of change in tilt angle for each frequency of the input signal at the time when the paired dielectric members 33, 34-1 to 34-3 and 35 provided in the phase shift circuit 1B serving as each of the phase shift circuits 1*a* to 1*f* shown in FIG. 1 are moved. Also in this simulation, the paired dielectric members 33, 34-1 to 34-3 and 35 shown in FIG. 7 are moved by +6 mm and by −6 mm. Moreover, the frequency of the input signal is changed within a range from 1.4 GHz to 2.2 GHz. As can be understood from FIG. 9, the amount of change in tilt angle is kept constant substantially at 12 degrees irrespective of the frequency of the input signal. More specifically, the frequency dependence of the amount of change in tilt angle with respect to the amount of movement of the paired dielectric members is reduced.

In the foregoing, the invention made by the inventors of the present invention has been concretely described based on the embodiments. However, the present invention is not limited to the foregoing embodiments and various modifications and alterations can be made within the scope of the present invention.

What is claimed is:

1. A phase shift circuit for changing a phase of a signal comprising:

a signal line made of metal in which a first region in which a first dielectric member is disposed, a second region in which no dielectric member is disposed and a third region in which a second dielectric member is disposed are provided in this order along a propagation direction of a signal, wherein widths of the first region and the third region are smaller than a width of the second region and thus a characteristic impedance of the first region and a characteristic impedance of the third region are higher than a characteristic impedance of the second region, the first dielectric member whose thickness is uniform when seen in a cross-sectional view and which has a triangular shape when seen in a plan view is disposed in the first region whose width is smaller than that of the second region, and the second dielectric member whose thickness is uniform when seen in a cross-sectional view and which has a triangular shape when seen in a plan view is disposed in the third region whose width is smaller than that of the second region.

2. The phase shift circuit according to claim 1, wherein the first dielectric member and the second dielectric member are movable in a direction intersecting with the signal line, the first region includes an overlapped region that is overlapped with the first dielectric member and a non-overlapped region that is not overlapped with the first dielectric member, the third region includes an overlapped region that is overlapped with the second dielectric member and a non-overlapped region that is not overlapped with the second dielectric member, an area ratio between the overlapped region and the non-overlapped region in the first region is varied with a movement of the first dielectric member, and an area ratio between the overlapped region and the non-overlapped region in the third region is varied with a movement of the second dielectric member.

3. The phase shift circuit according to claim 2, further comprising:

a moving mechanism for simultaneously moving the first dielectric member and the second dielectric member.

4. An antenna device comprising:

a plurality of phase shift circuits to which distributed signals are respectively input; and a plurality of antenna elements to which signals output from the respective phase shift circuits are input, wherein at least one of the plurality of phase shift circuits has a signal line made of metal in which a first region in which a first dielectric member is disposed, a second region in which no dielectric member is disposed and a third region in which a second dielectric member is disposed are provided in this order along a propagation direction of a signal, widths of the first region and the third region are smaller than a width of the second region and thus a characteristic impedance of the first region and a characteristic impedance of the third region are higher than a characteristic impedance of the second region, the first dielectric member whose thickness is uniform when seen in a cross-sectional view and which has a triangular shape when seen in a plan view is disposed in the first region whose width is smaller than that of the second region, and the second dielectric member whose thickness is uniform when seen in a cross-sectional view and which has a triangular shape when seen in a plan view is disposed in the third region whose width is smaller than that of the second region.

5. The antenna device according to claim 4, wherein the first dielectric member and the second dielectric member are movable in a direction intersecting with the signal line, the first region includes an overlapped region that is overlapped with the first dielectric member and a non-overlapped region that is not overlapped with the first dielectric member, the third region includes an overlapped region that is overlapped with the second dielectric member and a non-overlapped region that is not overlapped with the second dielectric member, an area ratio between the overlapped region and the non-overlapped region in the first region is varied with a movement of the first dielectric member, and an area ratio between the overlapped region and the non-overlapped region in the third region is varied with a movement of the second dielectric member.

6. The antenna device according to claim 5, further comprising:

a moving mechanism for simultaneously moving the first dielectric member and the second dielectric member.

7. A phase shift circuit for changing a phase of a signal comprising:

a signal line made of metal in which a first region in which a first dielectric member is disposed, a second region in which no dielectric member is disposed and a third region in which a second dielectric member is disposed are provided in this order along a propagation direction of a signal, wherein thicknesses of the first region and the third region are smaller than a thickness of the second region and thus a characteristic impedance of the first region and a characteristic impedance of the third region are higher than a characteristic impedance of the second region, the first dielectric member whose thickness is uniform when seen in a cross-sectional view and which has a triangular shape when seen in a plan view is disposed in the first region whose thickness is smaller than that of the second region, and the second dielectric member whose thickness is uniform when seen in a cross-sectional view and which has a triangular shape when seen in a plan view is disposed in the third region whose thickness is smaller than that of the second region.

8. The phase shift circuit according to claim 7, wherein the first dielectric member and the second dielectric member are movable in a direction intersecting with the signal line, the first region includes an overlapped region that is overlapped with the first dielectric member and a non-overlapped region that is not overlapped with the first dielectric member, the third region includes an overlapped region that is overlapped with the second dielectric member and a non-overlapped region that is not overlapped with the second dielectric member, an area ratio between the overlapped region and the non-overlapped region in the first region is varied with a movement of the first dielectric member, and an area ratio between the overlapped region and the non-overlapped region in the third region is varied with a movement of the second dielectric member.

9. The phase shift circuit according to claim 8, further comprising:

a moving mechanism for simultaneously moving the first dielectric member and the second dielectric member.

* * * * *